United States Patent [19]

Olney

[11] 4,273,147

[45] Jun. 16, 1981

[54] TRANSPORTATION AND PLACEMENT OF WATER-IN-OIL EXPLOSIVE EMULSIONS

[75] Inventor: Robert S. Olney, Bethlehem, Pa.

[73] Assignee: Atlas Powder Company, Dallas, Tex.

[21] Appl. No.: 30,425

[22] Filed: Apr. 16, 1979

[51] Int. Cl.[3] ..... F17D 1/16

[52] U.S. Cl. ..... 137/13; 149/108.8

[58] Field of Search ..... 137/13, 1; 149/108.8; 166/299

[56] References Cited

U.S. PATENT DOCUMENTS

| | | | |
|---|---|---|---|
| 2,821,205 | 1/1958 | Chilton | 137/13 |
| 3,066,733 | 12/1962 | Brandon | 166/299 |
| 3,414,004 | 12/1968 | Bankston | 137/13 X |
| 3,456,589 | 7/1969 | Thomison | 166/299 UX |
| 3,977,469 | 8/1976 | Broussard | 137/13 X |

*Primary Examiner*—Alan Cohan

*Attorney, Agent, or Firm*—Richards, Harris & Medlock

[57] ABSTRACT

A method and apparatus for the placement of emulsion explosive compositions is provided which substantially reduces the amount of work which must be expended to pump the explosive emulsion through a conduit and into a detonation site. This is accomplished by providing a substantially annular stream of a lubricating fluid such as water around the emulsion explosive being pumped, said stream being injected at a flow rate such that the linear velocity of the lubricating fluid is substantially the same as that of the emulsion explosive being pumped through the conduit.

3 Claims, 3 Drawing Figures

TRANSPORTATION AND PLACEMENT OF WATER-IN-OIL EXPLOSIVE EMULSIONS

BACKGROUND OF THE INVENTION

In one aspect, this invention relates to a method for the transportation and placement of water-in-oil emulsion explosive compositions. In a further aspect, this invention relates to an apparatus for the transportation and placement of emulsion explosive compositions including means for providing a substantially annular stream of a lubricating fluid surrounding the stream of emulsion explosive passing through a conduit.

The use of explosive emulsion compositions in various types of blasting operations has dramatically increased in recent years because of the economy and excellent explosive characteristics of such compositions. Basically, emulsion explosives comprise a water-in-oil emulsion wherein the oil phase is a hydrocarbon fuel component and the dispersed aqueous phase is an aqueous solution of inorganic oxidizing salts. Various other materials, including sensitizing agents and additional fuels for example, can be employed in a variety of different formulations. Typical water-in-oil emulsion explosive compositions are set forth in detail in U.S. Pat. No. 3,447,978 to Bluhm.

As is the case with other types of water containing slurry explosive compositions, one preferred method for placing the explosive composition into a detonation site, such as a borehole for example, includes pumping the emulsion explosive from a storage container thereof through a conduit and into the detonation site. While the pumping characteristics of any given explosive emulsion will vary with its composition and physical properties, the external oil phase of the emulsion causes these types of explosive compositions to be relatively difficult to pump through conduits. For example, emulsion explosive may exhibit pressure drops of from about 4 to about 7 psi per foot of one inch I.D. hose when pumped at a rate of 50 lbs./min. Thus, for example, to deliver an emulsion explosive from a storage supply thereof through a fifty foot length of such conduit, the discharge pressure at the pump employed with the system would be required to be in the range of from about 200 to about 350 psi. Thus, until recently, on site transportation and placement of emulsion explosives from storage tanks to detonation sites required heavy duty pumping apparatus capable of generating large pressure heads. Furthermore, pumping of such explosive emulsions through long lengths of conduit is practically prohibited. Also, the use of check valves in the pumping system under such high pressure presents a detonation hazard.

Another important consideration with respect to pumping explosive emulsion is that such compositions must be handled in a manner which ensures that the emulsion will not "break". That is, the explosive emulsion must not be subjected to such high shear stresses that the emulsion structure degrades (such as in the case when pumped at high pressures). It is important that the emulsion explosive not be allowed to intermix with other fluids to an extent which can adversely affect the explosive properties thereof once it has been placed into a detonation site, such as a borehole, for example.

SUMMARY OF THE INVENTION

According to the present invention, a method for the transportation and placement of explosive emulsion compositions is provided which substantially reduces the amount of pumping pressure which must be supplied. Basically, the method of the present invention comprises lubricating the flow of the emulsion explosive through the conduit by providing a substantially annular flow of a lubricating fluid, such as water for example, between the emulsion and the wall of the conduit. Generally, the flow rate of the lubricating fluid is equal to from about three to about five weight percent based on the flow rate of emulsion explosive. Because it is important that the explosive emulsion not become admixed with the lubricating fluid in a manner which will adversely affect its explosive properties, it has been discovered that the flow rate of the lubricating fluid at the point of injection into the conduit carrying the explosive emulsion should be such that the linear velocity of the lubricating fluid will be within a range of from about 50% greater to about 50% less than that of the explosive emulsion. This will reduce the tendency for turbulence to form, which can cause an intermixture of the lubricating fluid and emulsion which could adversely affect the explosives' detonation properties.

Also disclosed is a system which can be employed in the placement of emulsion explosive compositions which provides for the formation of an annular ring of a lubricating fluid surrounding the stream of explosive emulsion. Included in the system is a spray ring apparatus which provides for the metered introduction of the lubricating fluids in a manner such that the aforementioned turbulence and mixing of the emulsion explosives with the lubricating fluid, and the attendant problems, are avoided.

BRIEF DESCRIPTION OF THE DRAWINGS

The process and apparatus of the subject invention can be more easily understood from a study of the drawings in which.

DETAILED DESCRIPTION OF THE INVENTION

Figure 2:
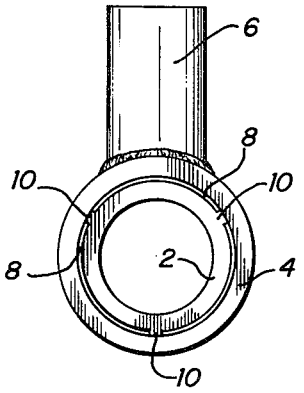
FIG. 2 is an end view of the spray ring apparatus of FIG. 1.

According to the process of the subject invention, a method for transporting emulsion explosive compositions and loading same into boreholes and similar detonation sites is provided which substantially reduces the amount of work which must be performed in order to effect such transportation and placement, while insuring that the explosive characteristics of the emulsion explosive at the detonation site will not be adversely affected. Basically, the method of the present invention comprises forming an annular lubricating film of water, or, where low temperatures are to be encountered, an aqueous solution of inorganic oxidizing salts, around an axial flow of the emulsion explosive as it travels through a conduit to a detonation site. It has been discovered that in order to provide a sufficient annular film of lubricating fluid from about three to about five weight percent of the lubricating fluid, based on the flow rate of the emulsion explosive, should be employed. Use of substantially larger amounts of lubricating fluid may adversely affect the explosive properties of the emulsion once it is placed in the detonation site. Further, it has been discovered that it is important to insure that a minimum amount of shear occurs at the interface between the emulsion explosive and the annular film of lubricating fluid during flow through the conduit. Excess shear at this interface may cause intermixing of the lubricating fluid with explosive emulsion, thereby both contaminating the explosive emulsion and reducing the effectiveness of the lubricating action. In order to avoid these problems, it has been discovered that the flow rates of the lubricating fluid and the emulsion explosive should preferably be matched such that substantially the same linear velocity will be obtained with respect to both these components at the point of injection of the lubricating fluid into the stream of emulsion explosive.

Typical pumpable emulsion explosive compositions are basically comprised of a continuous hydrocarbon fuel phase with a discontinuous aqueous oxidizer solution phase contained therein. Thus, for example, an explosive emulsion having from about 40 to about 75 percent by weight inorganic oxidizing salts (such as mixtures of ammonium nitrate, sodium nitrate and ammonium perchlorate, for example,) water, in a range of from about 10 to about 25 percent, mineral oils and waxes in a range of from about 5 to about 10 percent and various other fuels and sensitizing agents such as glass microspheres, can be employed in the process described herein.

Because such pumpable compositions have a continuous external oil phase, the use of an aqueous lubricating fluid, within the basic parameters set forth above, has been discovered to provide excellent reduction in the amount of work which must be expended to move the explosive emulsions through conduits and to detonation sites with substantially no adverse affect on the explosive characteristics of the emulsion. Thus, water alone can be used as the lubricating film formed substantially annularly around an axial flow of explosive emulsion passing through a conduit. Weight flow rates of from about 3 to about 5 percent of water have been found to be effective. On the other hand where pumping and/or placement temperatures will be in the range of about 0° to about 32° F., it has been discovered that the use of an aqueous solution of an inorganic oxidizing salt is especially effective.

Specifically it has been found that aqueous solutions of inorganic oxidizing salts having a salt concentration sufficient to depress the freezing point of the solution below that of water can be effectively employed in order to overcome problems due to changes in viscosity as a result of low temperatures. Solutions of ammonium nitrate, for example, comprising about 42 percent by weight ammonium nitrate have been found to be especially useful with explosive emulsions which employ ammonium nitrate as a primary oxidizing salt. Basically, any other aqueous salt solution can be employed so long as it is compatible with the particular explosive emulsion being pumped. Flow rates of such low temperature lubricating fluids in the range of from about 3 to about 5 percent, by weight, of the flow rate of the explosive emulsion can be employed.

Figure 1:
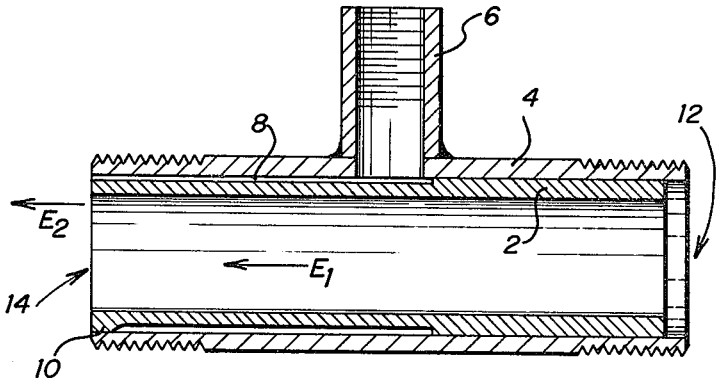
FIG. 1 is a cross sectional view of a spray ring apparatus useful in the present invention.

Referring to FIGS. 1 and 2, a cross sectional configuration (FIG. 1) and an end view (FIG. 2) of a spray ring apparatus useful in the formation of an annular ring of lubricating fluid about an axial flow of emulsion explosive through a conduit is shown. Thus, the spray ring apparatus basically comprises explosive emulsion conduit 2 contained annularly within lubricating fluid conduit 4 to which lubricating fluid injection conduit 6 is welded in a communicating fashion. Film forming annular space 8 is provided between lubricating fluid conduit 4 and explosive emulsion conduit 2 in a fashion such that the lubricating fluid entering via injection conduit 6 is distributed substantially evenly in an annular flow pattern around the explosive emulsion exiting from conduit 2. Even spacing can be provided by spacer legs 10 spaced substantially equidistant around the outlet end of annular space 8. Thus, an emulsion explosive can be pumped into the inlet end 12 of explosive emulsion conduit 2 and as it exits the outlet end 14 thereof a lubricating fluid selected from the group consisting of water and aqueous oxidizing salt solutions is introduced in an annular manner via injection conduit 6 and annular space 8. In this manner an annular film of lubricating fluid is formed substantially continuously around the axial flow of emulsion explosive composition. A delivery conduit substantially the same in interior diameter as lubricating fluid conduit 4 is used to transport the emulsion and lubricating fluid to the site of use.

It is important to note that, in order to insure that the explosive composition will reach the detonation site with substantially unimpaired explosive properties, turbulent intermixing between the lubricating fluid and the emulsion explosive should be avoided. Thus, it is important when calculating the precise measurements for emulsion conduit 2 and lubricating fluid conduit 4 and the annular space 8, therebetween, to take into account the linear velocities of the lubricating fluid and emulsion explosive exiting from the outlet end 14 of the spray ring apparatus. It has been discovered that by insuring that the flow rates and geometry of the spray ring are such that the linear velocities of the lubricating fluid are within a range of from about 50% greater to about 50% less than those of the emulsion explosive, turbulent intermixing of the two components can be avoided. Thus, the difference in velocities of the emulsion travelling through emulsion conduit 2 (represented by arrow $E_1$ in FIG. 1) and that of the emulsion as it exits therefrom (represented by arrow $E_2$ in FIG. 1) must be taken into account. The difference in cross sectional area between the emulsion conduit 2 and lubricating fluid conduit 4 will normally cause a reduction in fluid velocity of the emulsion as it passes from the former to the latter. While matched velocities are especially effective, the velocity of the lubricating fluid should always be kept within from about 50% greater to about 50% less than the velocity of the emulsion as it enters lubricating conduit 4 in order to avoid the problems which turbulence can cause.

Figure 3:
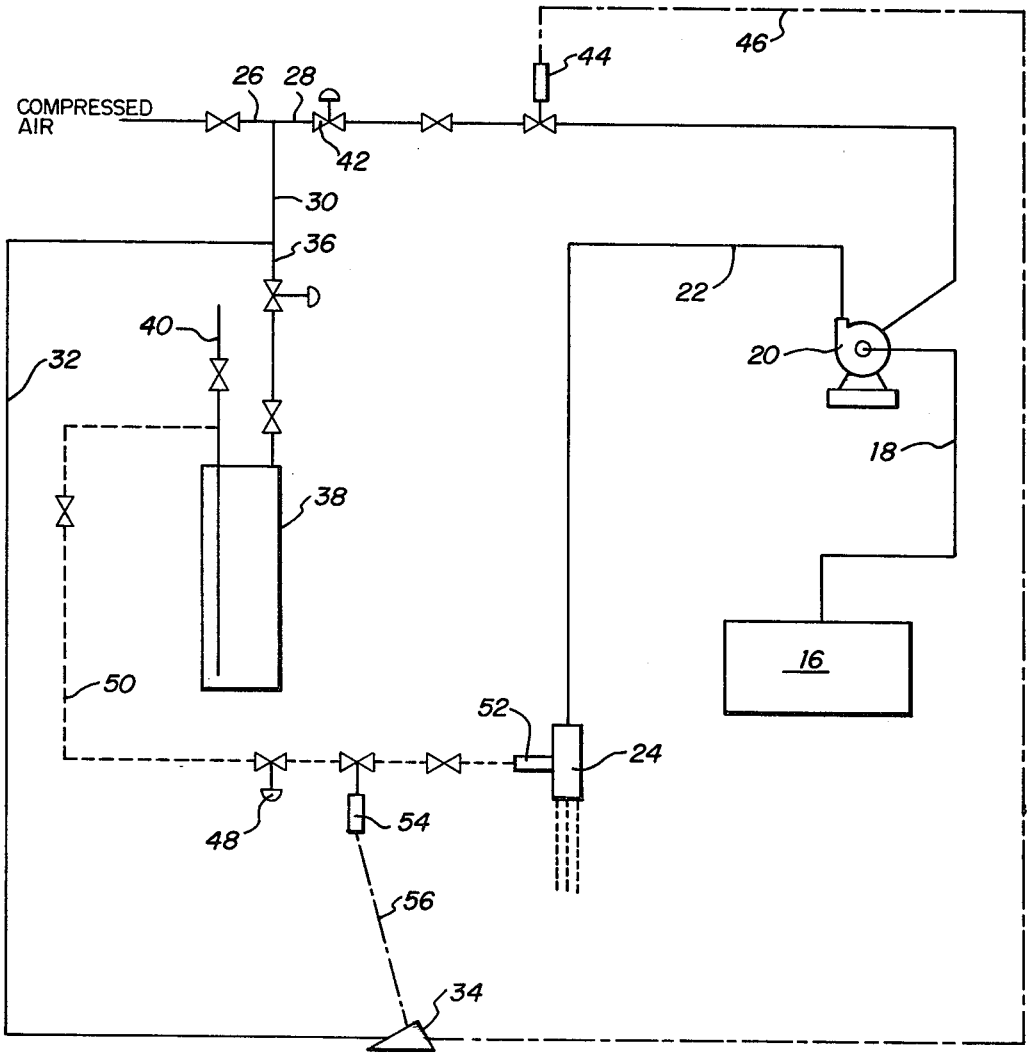
FIG. 3 is a schematic representation of a pumping and control apparatus useful in the process of the subject invention.

Now referring to FIG. 3, a schematic representation of one system which can be employed to practice the process of the subject invention is shown. Basically, the system comprises a holding tank or hopper 16 of explosive emulsion with a feed conduit 18 entering inlet side of pumping means 20. Outlet conduit 22 provides for the transportation of emulsion explosive to a spray ring apparatus 24, such as that described with relation to FIGS. 1 and 2. A compressed air supply is attached to conduit 26 so as to supply pressurized air to conduits 28 and 30. Conduit 30 supplies air to foot pedal valve 34 via conduit 32. Conduit 30 also supplies pressurized air to lubricating fluid holding tank 38 via conduit 36. When water is the lubricating fluid, any convenient water source can be attached to lubricating fluid inlet conduit 40.

Air pressure in conduit 28 is controlled by pressure valve 42, thus controlling the amount of air pressure delivered to pumping means 20 and thereby controlling the pumping rate thereof. Valve means 44, which can be a solenoid valve for example, is interconnected via air control line 46 to foot pedal valve 34. In a similar manner, the flow of lubricating fluid to spray ring apparatus 24 is controlled via needle valve 48 located along lubricating fluid supply line 50. The flow of lubricating fluid into the lubricating fluid inlet 52 of spray ring 24 is controlled by air controlled solenoid valve 54 which is interconnected with foot pedal valve 34 via air control line 56.

Thus, by setting needle valve 48 and pressure valve 42, the rate of flow of the emulsion explosive and lubricating fluid delivered to spray ring 24 can be controlled so as to keep the ratio of flow rates within the preferred 3 to 5 weight percent range. As set forth above, the cross sectional areas of the spray ring apparatus can be adjusted so as to provide the substantially matched linear velocities of lubricating film and emulsion explosive discussed above. The interconnection of the lubricating fluid source to the air line servicing the pumping means provides for simple operation whereby the operator can have his hands free to perform other functions during loading of explosive compositions.

EXAMPLE

This example is submitted for the purpose of demonstrating the reduction in the amount of work necessary to pump an explosive emulsion through a length of conduit. The emulsion explosive employed had the following formula.

| Weight Percent | Component |
|---|---|
| 54.7 | Ammonium Nitrate |
| 9.7 | Sodium Nitrate |
| 7.3 | Ammonium Perchlorate |
| 4.5 | Oil |
| 1.5 | Emulsifier |
| 2.0 | Glass Microspheres |
| 19.3 | Water |

This emulsion had a density of about 1.25. Pumping of the material without the aid of the present invention was determined to be both difficult and hazardous. However, calculations based on the rheological properties of the emulsion indicate that if the emulsion were pumped at a rate of approximately 75 lbs. per minute at 65° F. through 50 feet of one inch I.D. hose (fabricated from neoprene), a pressure drop of about 7.3 psi/foot would occur, thus requiring approximately 365 psi discharge pressure at the pump.

When the same emulsion was pumped through an apparatus similar to that shown in FIG. 3, whereby approximately four percent by weight of water was injected through the spray ring apparatus of FIGS. 1 and 2 to form an annular film of lubricating fluid around the axial flow of explosive emulsion as it was pumped through the hose, the required discharge pressure of the pump was lowered to approximately 35 psi. The velocity of the lubricating fluid as it entered the explosive emulsion conduit was approximately 65% of the velocity of the explosive emulsion at that point.

While this invention has been described with respect to the preferred embodiments, there are various modifications and alterations which will now be apparent to one of ordinary skill in the art and it is intended to cover all such modifications as fall within the scope of the appended claims.

What is claimed is:

1. A method for transporting water-in-oil explosive emulsions through conduits comprising injecting into said conduit a substantially annular stream of a lubricating fluid at a flow rate such that the linear velocity of said lubricating fluid is substantially equal to that of the explosive emulsion flowing through said conduit wherein said lubricating fluid comprises an aqueous solution of ammonium nitrate.

2. The method of claim 1 wherein said aqueous solution of ammonium nitrate comprises about 42 percent by weight ammonium nitrate.

3. A method for transporting explosive emulsion compositions through a conduit comprising lubricating the flow of said emulsion through said conduit by providing a substantially annular flow of a lubricating fluid which comprises an aqueous solution of ammonium nitrate said solution having a freezing point substantially lower than water, and having a linear velocity in a range of from about 50% greater to about 50% less than that of said explosive emulsion as it flows through said conduit.

* * * * *